US006756533B2

(12) United States Patent
Aoki

(10) Patent No.: US 6,756,533 B2
(45) Date of Patent: Jun. 29, 2004

(54) AUTOMATIC MUSIC COMPOSING APPARATUS AND AUTOMATIC MUSIC COMPOSING PROGRAM

(75) Inventor: Eiichiro Aoki, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 25 days.

(21) Appl. No.: 10/098,673

(22) Filed: Mar. 15, 2002

(65) Prior Publication Data

US 2002/0134219 A1 Sep. 26, 2002

(30) Foreign Application Priority Data

Mar. 23, 2001 (JP) ..... 2001-084482

(51) Int. Cl.[7] ..... G10H 1/100

(52) U.S. Cl. ..... 84/609; 84/610; 84/612; 84/600

(58) Field of Search ..... 84/600–607, 609–614, 84/645, 636, 668, 477 R, 649–652; 345/978; 352/1; 386/66

(56) References Cited

U.S. PATENT DOCUMENTS 5,693,903 A * 12/1997 Heidorn et al. ..... 84/668
6,072,480 A * 6/2000 Gorbet et al. ..... 345/730
6,084,169 A * 7/2000 Hasegawa et al. ..... 84/600
6,175,072 B1 1/2001 Aoki
6,392,133 B1 * 5/2002 Georges ..... 84/609

* cited by examiner

*Primary Examiner*—Robert Nappi
*Assistant Examiner*—David Warren
(74) *Attorney, Agent, or Firm*—Morrison & Foerster LLP

(57) ABSTRACT

An automatic music composing apparatus is provided, which is capable of generating music with a high degree of completion in synchronization with images and in a time that matches the length of images. The automatic music composing apparatus automatically creates musical compositions to be reproduced as a background for images. A number of bars of a musical composition that corresponds to a time period required by each of sections of images is calculated. Bar number-corresponding data necessary to generate the musical composition and corresponding to the calculated number of bars is acquired. The musical composition based on the acquired bar number-corresponding data is generated. The generated musical composition is outputted according to each of the sections of the images.

21 Claims, 9 Drawing Sheets

*FIG. 4*

| | |
|---|---|
| TIME POINTER | P1 |
| | TEMPLATE "RACE" |
| TIME POINTER | P2 |
| | TEMPLATE "CHEERFUL" |
| TIME POINTER | P3 |
| | TEMPLATE "RELAXED" |

FIG. 7

N: NUMBER OF PASSAGES
P: PRIORITY
R: RESPECTIVE PASSAGE NUMBERS

| | N | 1 | | 2 | | 3 | | 4 | | 5 | | 6 | | 7 | | 8 | | 9 | | 10 | |
|---|---|---|---|---|---|---|---|---|---|---|---|---|---|---|---|---|---|---|---|---|---|
| | | P | R | P | R | P | R | P | R | P | R | P | R | P | R | P | R | P | R | P | R |
| BLOCK DIVISION STRUCTURE | A | | 1 | | 2 | | | | | | | | | | | | | | | | |
| | AB BA | | | | | | 1+2 | | 2+2 | | 2+3 | | 2+4 | | 3+4 | | 4+4 | | | | |
| | | | | | | | 2+1 | | | | 3+2 | | 3+3 | | 4+3 | | | | | | |
| | | | | | | | | | | | | | 4+2 | | | | | | | | |
| | ABA BAB | | | | | | | | | | | | | | | | | | | | |
| | | | | | | | | | 1+1+2 | | 1+2+2 | | 2+2+2 | | 2+2+3 | | 2+3+3 | | 2+3+4 | | 3+3+4 |
| | | | | | | | | | 1+2+1 | | 2+1+2 | | 1+2+1+2 | | 2+3+2 | | 3+2+3 | | 2+4+3 | | 3+4+3 |
| | | | | | | | | | 2+1+1 | | 2+2+1 | | 2+1+2+1 | | 3+2+2 | | 3+3+2 | | 3+2+4 | | 4+2+4 |
| | | | | | | | | | | | | | | | | | | | 4+2+3 | | |
| | ABAB BABA | | | | | | | | | | | | | | 2+1+2+2 | | 2+2+1+3 | | 2+2+2+3 | | 2+2+3+3 |
| | | | | | | | | | | | | | | | 2+2+1+2 | | 2+2+2+2 | | 2+2+3+2 | | 2+3+2+3 |
| | | | | | | | | | | | | | | | 2+2+2+1 | | 2+3+1+2 | | 2+3+2+2 | | 2+3+3+2 |
| | | | | | | | | | | | | | | | | | | | 3+2+2+2 | | 3+2+2+3 |
| | | | | | | | | | | | | | | | | | | | | | 3+2+3+2 |
| | | | | | | | | | | | | | | | | | | | | | 3+3+2+2 |

| | N | 11 | | 12 | | 13 | | 14 | | 15 | | 16 | | 17 | | 18 | | 19 | | 20 | |
|---|---|---|---|---|---|---|---|---|---|---|---|---|---|---|---|---|---|---|---|---|---|
| | | P | R | P | R | P | R | P | R | P | R | P | R | P | R | P | R | P | R | P | R |
| BLOCK DIVISION STRUCTURE | ABA BAB | | 2+4+5 | | 4+3+5 | | | | | | | | | | | | | | | | |
| | | | 2+5+4 | | 4+4+4 | | | | | | | | | | | | | | | | |
| | | | 3+4+4 | | 4+5+3 | | | | | | | | | | | | | | | | |
| | | | 4+3+4 | | 5+3+4 | | | | | | | | | | | | | | | | |
| | | | 4+4+3 | | 5+4+3 | | | | | | | | | | | | | | | | |
| | ABAB BABA | | 2+2+2+3 | | 3+2+3+4 | | | | | | | | | | | | | | | | |
| | | | 2+2+3+2 | | 3+3+2+4 | | | | | | | | | | | | | | | | |
| | | | 2+3+2+2 | | 3+4+2+3 | | | | | | | | | | | | | | | | |
| | | | | | 4+2+3+3 | | | | | | | | | | | | | | | | |
| | | | | | 4+3+3+2 | | | | | | | | | | | | | | | | |

*FIG. 8*

N: NUMBER OF PASSAGES
P: PRIORITY
S: STRUCTURE

| N | 1 | | 2 | | 3 | | 4 | | 5 | | 6 | | 7 | | 8 | | 9 | | 10 | |
|---|---|---|---|---|---|---|---|---|---|---|---|---|---|---|---|---|---|---|---|---|
| | P | S | P | S | P | S | P | S | P | S | P | S | P | S | P | S | P | S | P | S |
| DIVISION | | a | | aa | | aaa | | aaba | | | | | | | | | | | | |
| | | | | aa' | | aaa' | | aaba' | | | | | | | | | | | | |
| | | | | ab | | aab | | aabb | | | | | | | | | | | | |
| | | | | | | aa'b | | aabb' | | | | | | | | | | | | |
| | | | | | | aba | | aabc | | | | | | | | | | | | |
| | | | | | | aba' | | aabb' | | | | | | | | | | | | |
| | | | | | | abb' | | aa'bc | | | | | | | | | | | | |
| | | | | | | abc | | abab | | | | | | | | | | | | |
| | | | | | | | | abab' | | | | | | | | | | | | |
| | | | | | | | | abac | | | | | | | | | | | | |
| | | | | | | | | abab' | | | | | | | | | | | | |
| | | | | | | | | abac | | | | | | | | | | | | |
| | | | | | | | | abab' | | | | | | | | | | | | |
| | | | | | | | | abac | | | | | | | | | | | | |
| | | | | | | | | abab' | | | | | | | | | | | | |
| | | | | | | | | abac | | | | | | | | | | | | |
| | | | | | | | | abab' | | | | | | | | | | | | |
| | | | | | | | | abac | | | | | | | | | | | | |
| | | | | | | | | abab' | | | | | | | | | | | | |

AUTOMATIC MUSIC COMPOSING APPARATUS AND AUTOMATIC MUSIC COMPOSING PROGRAM

BACKGROUND OF THE INVENTION

1. Field of the Invention

The present invention relates to an automatic music composing apparatus and automatic music composing program that create musical compositions in synchronization with images.

2. Description of the Related Art

Conventionally, a background music (referred to below as BGM) generator is known that generates BGM in synchronization with images so that the BGM matches the mood of the images. In this BGM generator, fragment data (including accompaniment data and data for generating a melody) of a plurality of songs is prerecorded on a database. When a music genre or rhythm that matches the mood of the images and the length (e.g., the length of time or number of frames of the images) of the images to which a user wishes to attach the BGM is specified by an input from the user, fragment data of music that matches the specification by the user is read from the database. The read fragment data of this music is joined together in the correct manner to generate BGM that matches the length of the images.

However, since music is thus generated by the conventional BGM generator by joining together fragments of data of music, when a single musical composition is generated by joining together fragment data, the music has little sense of continuity.

Moreover, in spite of groups of data for generating a plurality of melodies being registered in the database for one set of accompaniment data, only a few musical compositions can be generated using the same accompaniment source. If fragment data prepared for another accompaniment is used, then the number of musical compositions that can be generated using the same accompaniment source does increase somewhat, however, the accompaniment and the melody conflict with each other in many cases so that, hitherto, the music has only seemed partially completed.

SUMMARY OF THE INVENTION

It is an object of the present invention to provide an automatic music composing apparatus and an automatic music composing program capable of generating music with a high degree of completion in synchronization with images and in a time that matches the length of images.

To attain the above object, in a first aspect of the present invention, there is provided an automatic music composing apparatus that automatically creates musical compositions to be reproduced as a background for images, comprising a bar number calculating device that calculates a number of bars of a musical composition that corresponds to a time period required by each of sections of images, a bar number-corresponding data acquiring device that acquires bar number-corresponding data necessary to generate the musical composition and corresponding to the calculated number of bars, a musical composition generating device that generates the musical composition based on the acquired bar number-corresponding data, and an output device that outputs the generated musical composition according to each of the sections of the images.

Preferably, the automatic music composing apparatus according to the first aspect comprises a musical composition length adjusting device that adjusts a length of the musical composition such that the generated musical composition has a length matching a time period required by a corresponding one of the sections of the images, and wherein the output device outputs the musical composition having the length thereof adjusted, according to each of the sections of the images.

Also preferably, the bar number-corresponding data acquiring device acquires the bar number-corresponding data in units of a predetermined number of bars, and wherein the apparatus comprises a deleting device that deletes a portion of the bar number-corresponding data such that the acquired bar number-corresponding data corresponds to a number of bars that is greater than and is closest to a number of bars required for generating the musical composition.

To attain the above object, in the first aspect of the present invention, there is also provided an automatic music composing program that is executed by a computer, comprising a bar number calculating module for calculating a number of bars of a musical composition that corresponds to a time period required by each of sections of images, a bar number-corresponding data acquiring module for acquiring bar number-corresponding data necessary to generate the musical composition and corresponding to the calculated number of bars, a musical composition generating module for generating the musical composition based on the acquired bar number-corresponding data, and an output module for outputting the generated musical composition according to each of the sections of the images.

To attain the above object, in a second aspect of the present invention, there is provided an automatic music composing apparatus that automatically creates musical compositions to be reproduced as a background for images, comprising a bar number calculating device that calculates a number of bars of a musical composition that corresponds to a time period required by each of sections of images, a bar number-corresponding data acquiring device that acquires bar number-corresponding data necessary to generate the musical composition and corresponding to the calculated number of bars in units of a predetermined number of bars, the bar number-corresponding data acquiring device acquiring the bar number-corresponding data that corresponds to a number of bars that is greater than and is closest to a number of bars required for generating the musical composition, a musical composition generating device that generates the musical composition based on the acquired bar number-corresponding data, a musical composition length adjusting device that adjusts a length of the musical composition such that has a length matching a time period required by a corresponding one of the sections of the images, and an output device that outputs the musical composition having the length thereof adjusted, according to each of the sections of the images.

Preferably, in the automatic music composing apparatus according to the second aspect, the musical composition length adjusting device comprises a bar number deleting device that deletes a portion of the number of bars of the musical composition generated by the musical composition generating device, a tempo adjusting device that adjusts a tempo of the musical composition generated by the musical composition generating device, and/or an insertion device that inserts a ritardando or fermata in the musical composition generated by the musical composition generating device.

To attain the above object, in the second aspect of the present invention, there is also provided an automatic music composing program that is executed by a computer, comprising a bar number calculating module for calculating a number of bars of a musical composition that corresponds to a time period required by each of sections of images, a bar number-corresponding data acquiring module for acquiring bar number-corresponding data necessary to generate the musical composition and corresponding to the calculated number of bars in units of a predetermined number of bars, the bar number-corresponding data acquiring module acquiring the bar number-corresponding data that corresponds to a number of bars that is greater than and is closest to a number of bars required for generating the musical composition, a musical composition generating module for generating the musical composition based on the acquired bar number-corresponding data, a musical composition length adjusting module for adjusting a length of the musical composition such that has a length matching a time period required by a corresponding one of the sections of the images, and an output module for outputting the musical composition having the length thereof adjusted, according to each of the sections of the images.

To attain the above object, in a third aspect of the present invention, there is provided an automatic music composing apparatus that automatically creates musical compositions to be reproduced as a background for images, comprising a musical composition generation data acquiring device that acquires data for generating a musical composition appropriate to contents of images, the musical composition generation data including at least one data set each containing a plurality of types of musical composition generation parameters, a musical composition generating device that generates the musical composition based on the acquired musical composition generation data for each of the contents of the images, and an output device that outputs the generated musical composition together with the images.

Preferably, in the automatic music composing apparatus according to the third aspect, the musical composition generation data acquiring device comprises a musical composition generation data storage device that stores a plurality of sections of musical composition generation data classified into predetermined categories, and a musical composition generation data selecting device that selects desired musical composition generation data from the musical composition generation data storage device, and wherein the musical composition generation data selecting device selects musical composition generation data classified into categories appropriate to the contents of the images.

Also preferably, the automatic music composing apparatus according to the third aspect further comprises a section forming device that divides the images into a plurality of sections, and wherein the musical composition generation data acquiring device acquires the musical composition generation data for each of the sections of the images, the musical composition generating device generates the musical composition data for each of the sections of the images, and the output device outputs the musical composition data generated for each of the sections in correspondence with each of the sections of the images.

To attain the above object, in the third aspect of the present invention, there is also provided an automatic music composing program that is executed by a computer, comprising a musical composition generation data acquiring module for acquiring data for generating a musical composition appropriate to contents of images, the musical composition generation data including at least one data set each containing a plurality of types of musical composition generation parameters, a musical composition generating module for generating the musical composition based on the acquired musical composition generation data for each of the contents of the images, and an output module for outputting the generated musical composition together with the images.

To attain the above object, in a fourth aspect of the present invention, there is provided an automatic music composing apparatus that automatically creates musical compositions to be reproduced as a background for images, comprising a bar number calculating device that calculates a number of bars of a musical composition that corresponds to a time period required by images, a bar number-corresponding data acquiring device that acquires bar number-corresponding data necessary to generate the musical composition and corresponding to the calculated number of bars, a musical composition generating device that generates the musical composition based on the acquired bar number-corresponding data, and an output device that outputs the generated musical composition together with the images.

To attain the above object, in the fourth aspect of the present invention, there is also provided an automatic music composing program that is executed by a computer, comprising a bar number calculating module for calculating a number of bars of a musical composition that corresponds to a time period required by images, a bar number-corresponding data acquiring module for acquireing bar number-corresponding data necessary to generate the musical composition and corresponding to the calculated number of bars, a musical composition generating module for generating the musical composition based on the acquired bar number-corresponding data, and an output module for outputting the generated musical composition together with the images To attain the above object, in a fifth aspect of the present invention, there is provided an automatic music composing apparatus that automatically creates musical compositions to be reproduced as a background for images, comprising a bar number calculating device that calculates a number of bars of a musical composition that corresponds to a given required time period, a bar number-corresponding data acquiring device that acquires bar number-corresponding data necessary to generate the musical composition and corresponding to the calculated number of bars in units of a predetermined number of bars, the bar number-corresponding data acquiring device acquiring the bar number-corresponding data that corresponds to a number of bars that is greater than and is closest to a number of bars required for generating the musical composition, a bar number-corresponding data length adjusting device that adjusts a length of the acquired bar number-corresponding data by deleting part of bars of the acquired bar number-corresponding data from a leading end the acquired bar number-corresponding data so that the bar number-corresponding data matches the calculated number of bars, and a musical composition generating device that generates the musical composition based on the bar number-corresponding data having a number of bars thereof adjusted.

To attain the above object, in the fifth aspect of the present invention, there is also provided an automatic music composing program that is executed by a computer, comprising a bar number calculating module for calculating a number of bars of a musical composition that corresponds to a given required time period, a bar number-corresponding data acquiring module for acquiring bar number-corresponding data necessary to generate the musical composition and corresponding to the calculated number of bars in units of a predetermined number of bars, the bar number-corresponding data acquiring module acquiring the bar number-corresponding data that corresponds to a number of bars that is greater than and is closest to a number of bars required for generating the musical composition, a bar number-corresponding data length adjusting module for adjusting a length of the acquired bar number-corresponding data by deleting part of bars of the acquired bar number-corresponding data from a leading end the acquired bar number-corresponding data so that the bar number-corresponding data matches the calculated number of bars, and a musical composition generating module for generating the musical composition based on the bar number-corresponding data having a number of bars thereof adjusted.

To attain the above object, in a sixth aspect of the present invention, there is provided an automatic music composing apparatus that automatically creates musical compositions to be reproduced as a background for images, comprising a bar number calculating device that calculates a number of bars of a musical composition that corresponds to a given required time period, a bar number-corresponding data acquiring device that acquires bar number-corresponding data necessary to generate the musical composition and corresponding to the calculated number of bars in units of a predetermined number of bars, the bar number-corresponding data acquiring device acquiring the bar number-corresponding data that corresponds to a number of bars that is greater than and is closest to a number of bars required for generating the musical composition, a musical composition generating device that generates the musical composition based on the acquired bar number-corresponding data, and a musical composition length adjusting device that adjusts a length of the musical composition such that the generated musical composition has a length matching the required time period.

Preferably, in the automatic music composing apparatus according to the sixth aspect, the musical composition adjustment device comprises a bar number deleting device that deletes part of bars of the generated musical composition from a leading end of the generated musical composition.

To attain the above object, in the sixth aspect of the present invention, there is also provided an automatic music composing program that is executed by a computer, comprising a bar number calculating module for calculating a number of bars of a musical composition that corresponds to a given required time period, a bar number-corresponding data acquiring module for acquiring bar number-corresponding data necessary to generate the musical composition and corresponding to the calculated number of bars in units of a predetermined number of bars, the bar number-corresponding data acquiring module acquiring the bar number-corresponding data that corresponds to a number of bars that is greater than and is closest to a number of bars required for generating the musical composition, a musical composition generating module for generating the musical composition based on the acquired bar number-corresponding data, and a musical composition length adjusting module for adjusting a length of the musical composition such that the generated musical composition has a length matching the required time period.

According to the first to sixth aspects of the present invention, as is distinct from the conventional apparatus in which fragments of music data are simply joined together, music having a high degree of completion can be generated in synchronization with images and in a time that matches the length of the images.

Moreover, according to the first aspect of the present invention, since the bar number-corresponding data acquiring device acquires the bar number-corresponding data in units of a predetermined number of bars, and wherein the apparatus comprises a deleting device that deletes a portion of the bar number-corresponding data such that the acquired bar number-corresponding data corresponds to a number of bars that is greater than and is closest to a number of bars required for generating the musical composition, bar number-corresponding data that corresponds to the number of bars necessary to generate music can be acquired before the musical composition is generated.

Furthermore, according to the second aspect of the present invention, since the musical composition length adjusting device comprises a bar number deleting device that deletes a portion of the number of bars of the musical composition generated by the musical composition generating device, a tempo adjusting device that adjusts a tempo of the musical composition generated by the musical composition generating device, and/or an insertion device that inserts a ritardando or fermata in the musical composition generated by the musical composition generating device, music having a high degree of completion can be generated in a time that matches the length of the images after the musical composition is generated.

In addition, according to the sixth aspect of the present invention, a musical composition having a length that corresponds to a given required time period can be generated.

The above and other objects, features and advantages of the invention will become more apparent from the following detailed description taken in conjunction with the accompanying drawings.

BRIEF DESCRIPTION OF THE DRAWINGS

FIG. 4 is a view showing a memory map in a predetermined area of RAM 7 at the time point when template specifying of step S3 of FIG. 3 is completed;

FIG. 7 is a view showing a table representing the correspondence between block structures that can be selected and the number of passages; and FIG. 8 is a view showing a table representing the correspondence between passage structures that can be selected and the number of passages.

DETAILED DESCRIPTION OF THE PREFERRED EMBODIMENTS

The present invention will now be described in detail based on the drawings showing embodiments thereof.

Figure 1:
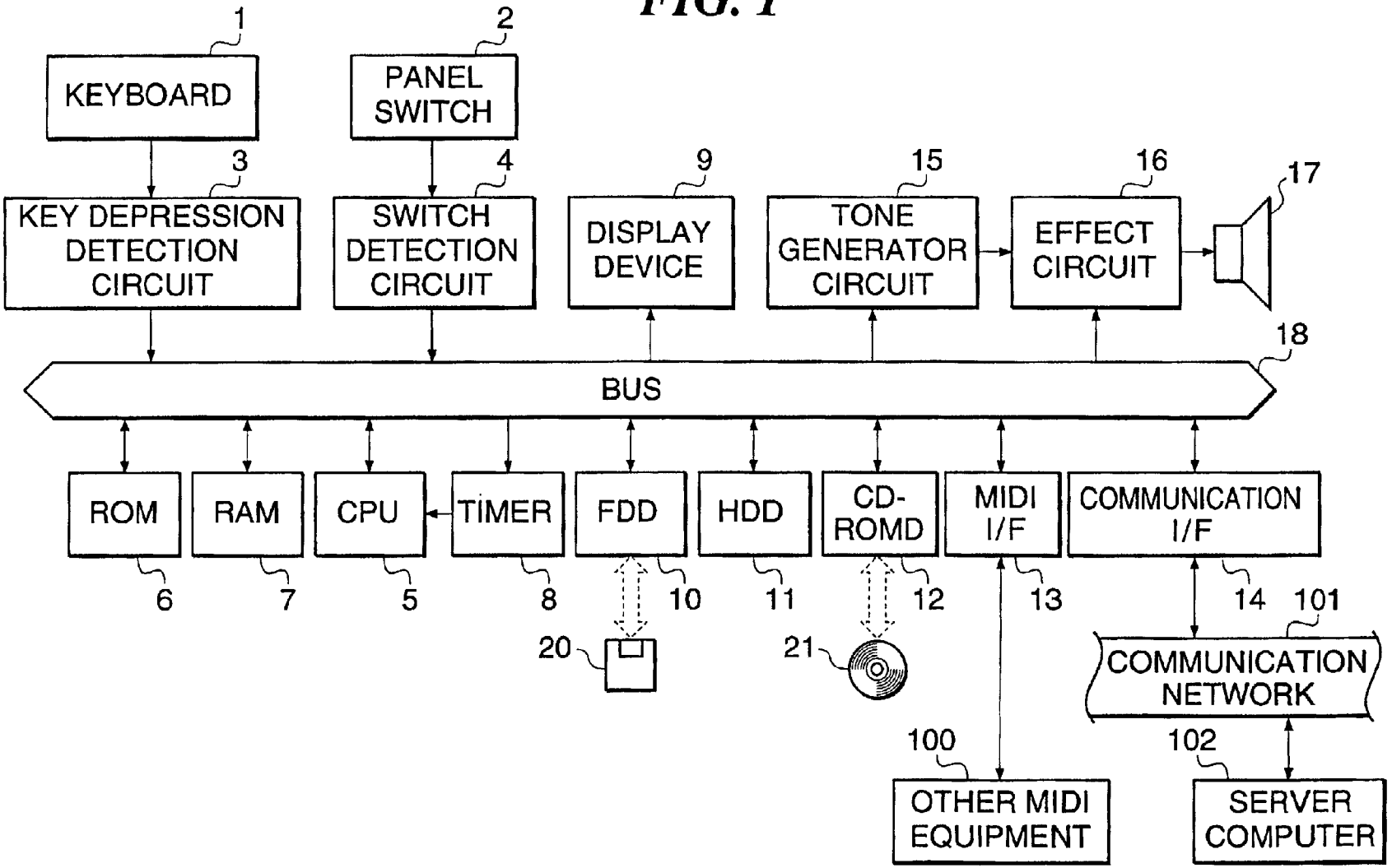
FIG. 1 is a block diagram showing the schematic construction of an automatic music composing apparatus according to an embodiment of the present invention.

FIG. 1 is a block diagram showing the schematic construction of an automatic music composing apparatus according to an embodiment of the present invention.

As shown in FIG. 1, the automatic music composing apparatus according to the present embodiment is comprised of a keyboard 1 for inputting pitch information, a panel switch 2 provided with a plurality of switches for inputting various kinds of information, a key depression detection circuit 3 for detecting depressed states of each key of the keyboard 1, a switch detection circuit 4 for detecting depressed states of each switch of the panel switch 2, a CPU 5 for controlling the overall apparatus, and a ROM 6 storing a control program executed by the CPU 5, various kinds of table data, data (including templates for generating music) for generating music, described below, a bar number-corresponding data generating database B8 (including bar number-corresponding data generating templates), described below, and other data. The automatic music composing apparatus is also provided with a RAM 7 for temporarily storing various kinds of input information, calculation results, time pointers, templates for generating music, and the like, a timer 8 for measuring interrupt time during timer interrupt processing and other periods of time, a display device 9 having, for example, a large-scale liquid crystal display (LCD) or cathode ray tube (CRT) display as well as a light emitting diode (LED) and the like for displaying various kinds of information, a floppy disk drive (FDD) 10 for driving a floppy disk (FD) 20 serving as a storage medium, a hard disk drive 11 for driving a hard disk (not shown) that stores various application programs including the aforementioned control program, images, various kinds of data, and the like, a CD-ROM drive (CD-ROMD) 12 for driving a compact disk read only memory (CD-ROM) that stores various application programs including the aforementioned control program, various kinds of data, and the like, a musical instrument digital interface (MIDI) interface (I/F) 13 used for inputting MIDI signals from the outside and for outputting MIDI signals to the outside, a communication interface (I/F) 14 for exchanging data with, for example, a server computer 102 via a communication network 101, a tone generator circuit 15 that converts performance data input from the keyboard 1, preset performance data, and the like into musical tone signals, an effect circuit for imparting various effects to the musical tone signals from the tone generator circuit 15, and a sound system 17 such as a digital-to-analog converter (DAC) and amplifier, speakers, and the like for converting musical tone signals from the effect circuit 16 into sound.

The above component elements 3 to 16 are connected with each other via a bus 18. The timer 8 is connected to the CPU 5. Other MIDI equipment 100 is connected to the MIDI I/F 13. A communication network 101 is connected to the communication I/F 14. The effect circuit 16 is connected to the tone generator circuit 15, and the sound system 17 is connected to the effect circuit 16.

As mentioned above, the control program that is executed by the CPU 5 can be stored in the hard disk of the HDD 11. Further, a control program is stored on the hard disk when no control program is stored in the ROM 6. By reading this control program and loading it into the RAM 7, the same operation as when the control program is stored in the ROM 6 can be carried out by the CPU 5. By employing this structure, addition of control programs, version updating and the like can be easily made.

Control programs and data read from the CD-ROM 21 via the CD-ROM drive 12 are stored in the hard disk in the HDD 11. As a result, new installation of control programs, version updating and the like can be easily made. It is also possible to provide other devices as external storage devices as well as the CD-ROM drive 12 in order to utilize a variety of media formats such as a magneto-optical disk (MO).

The MIDI I/F 13 is not limited to a dedicated interface and may be formed by another general purpose interface such as an RS-232C, a universal serial bus (USB), and an IEEE 1394 (I triple E 1394). In this case, data in addition to MIDI messages may be transmitted and received via the MIDI I/F 13.

As mentioned above, the communication I/F 14 is connected, for example, to a local area network (LAN), the Internet, or the communication network 101 such as a telephone circuit, and is connected via the communication network 101 to a server computer 102. When the respective programs mentioned above and various parameters are not stored in the hard disk in the HDD 11, the communication I/F 14 is used to download programs and parameters from the server computer 102. A client computer (in the present embodiment, the automatic music composing apparatus) sends commands requesting downloading of programs and parameters to the server computer 102 via the communication I/F 14 and the communication network 101. The server computer 102 receives these commands and sends the requested programs and parameters to the computer via the communication network 101. The computer receives the programs and parameters via the communication I/F 14 and completes the downloading by storing the programs and parameters in the hard disk in the HDD 11.

An additional interface may be provided for exchanging data directly with an external computer or the like.

Figure 2:
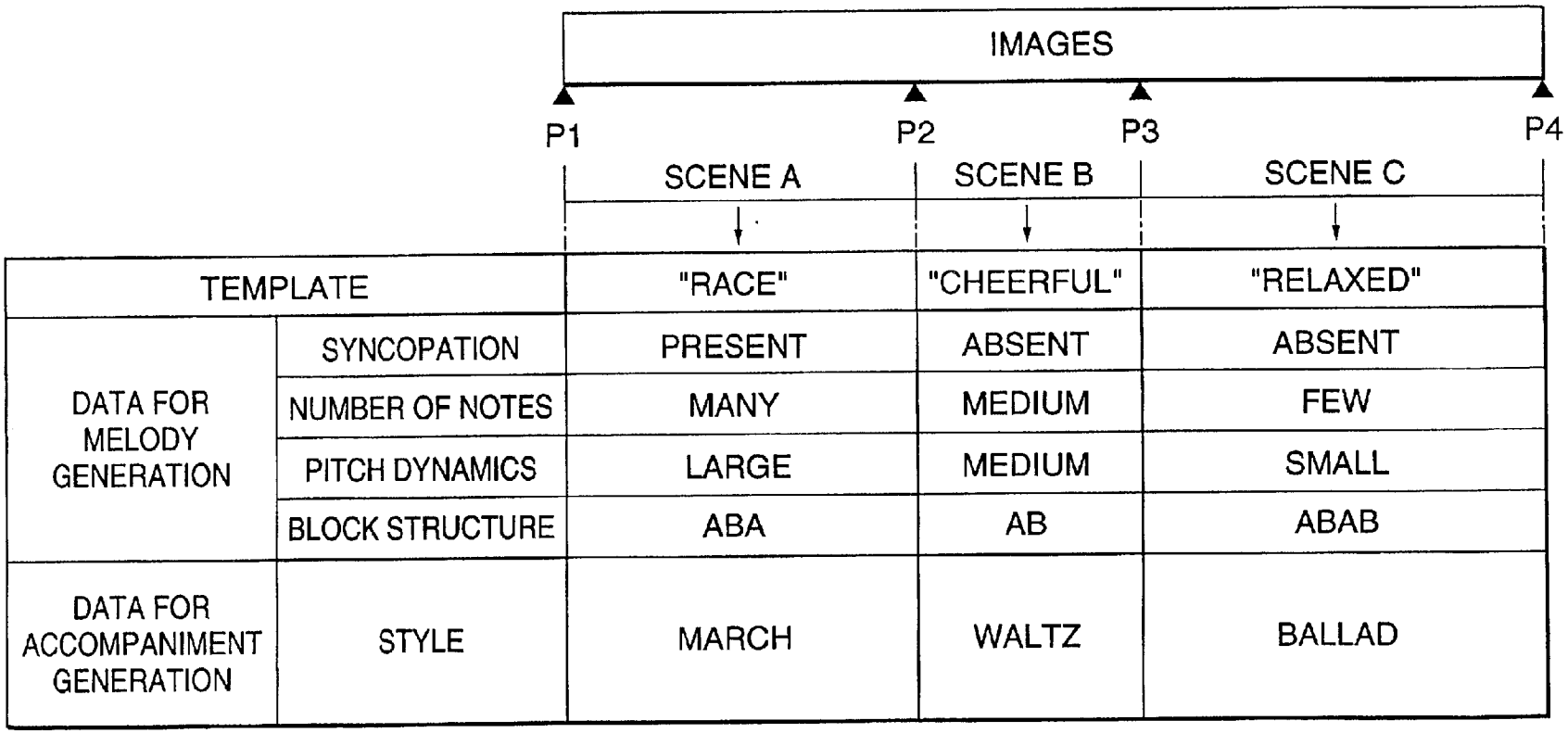
FIG. 2 is a view showing an example of data for music generating allocated to particular image scenes.

FIG. 2 is a view showing an example of music generating data allocated to particular images, used in the automatic music composing apparatus according to the present embodiment.

In FIG. 2, reference numerals P1 to P4 designate time pointers indicating the progress time of image data. The time pointers P2 to P4 respectively indicate lapsed times (namely, absolute time) from the time pointer Pi.

Images of the image data are separated into sections (groups of images or scenes) by the time pointers, and to each of the sections is added music suitable for the images of the section. If, for example, scene A between the time pointer P1 and the time pointer P2 is a scene depicting a children's running race, music of "Lively March" is added to the scene. If scene B between the time pointer P2 and the time pointer P3 is a scene depicting children playing, then music of "Elegant Waltz" is added to the scene.

Music generating data for generating these pieces of music is stored in the ROM 6 as music generating templates. The name of each music generating template may be the same name as that of the music i.e., "Lively March" or "Elegant Waltz", or may be a keyword such as "Race", "Cheerful", or "Relaxed" as in FIG. 2. Folders such as "Festivals", "Wedding Ceremonies", "National", "Sad Scenes" may also be prepared and stored in the ROM 6, and a plurality of music generating templates stored in each folder. Namely, the music generating templates may be classified into predetermined categories ("Lively March", Elegant Waltz", "race", "Cheerful" etc.) based on the name, keyword, folder, or the like, and music generating data that has been classified into a category that is appropriate to the image contents is selected and added to the images.

Each music generating template has at least data for generating a melody and, where necessary, has data for generating a musical accompaniment. The melody generating data has at least three parameters, namely, "Syncopation", "Number of Musical Notes", and "Pitch Dynamics". The accompaniment generating data has a single parameter, "Style". For example, in the data of the parameters of the music generating template "Race" shown in FIG. 2, "Syncopation" is set to "Present", "Number of Musical Notes" is set to "Many", "Pitch Dynamics" is set to "High" and "Style" is set to "March".

It is to be noted that each of the above described time pointers shows the length of lapsed time from the time pointer P1 in order to group the images, however, the present embodiment is not limited to this and a required time period (namely, a relative time period between two pointers) may be set for each time pointer. Thus, the images may be grouped into required time periods for the images to be reproduced, such as, for example, 1 minute 30 seconds for the time pointers P2 to P1, 20 seconds for the time pointers P3 to P2, and 2 minutes 10 seconds for the time pointers P4 to P3. It is also to be understood that each time pointer is not limited to a required time period for the group of images, and the images may also be grouped according to the number of image frames (i.e., the absolute frame number or relative frame number).

Figure 3:
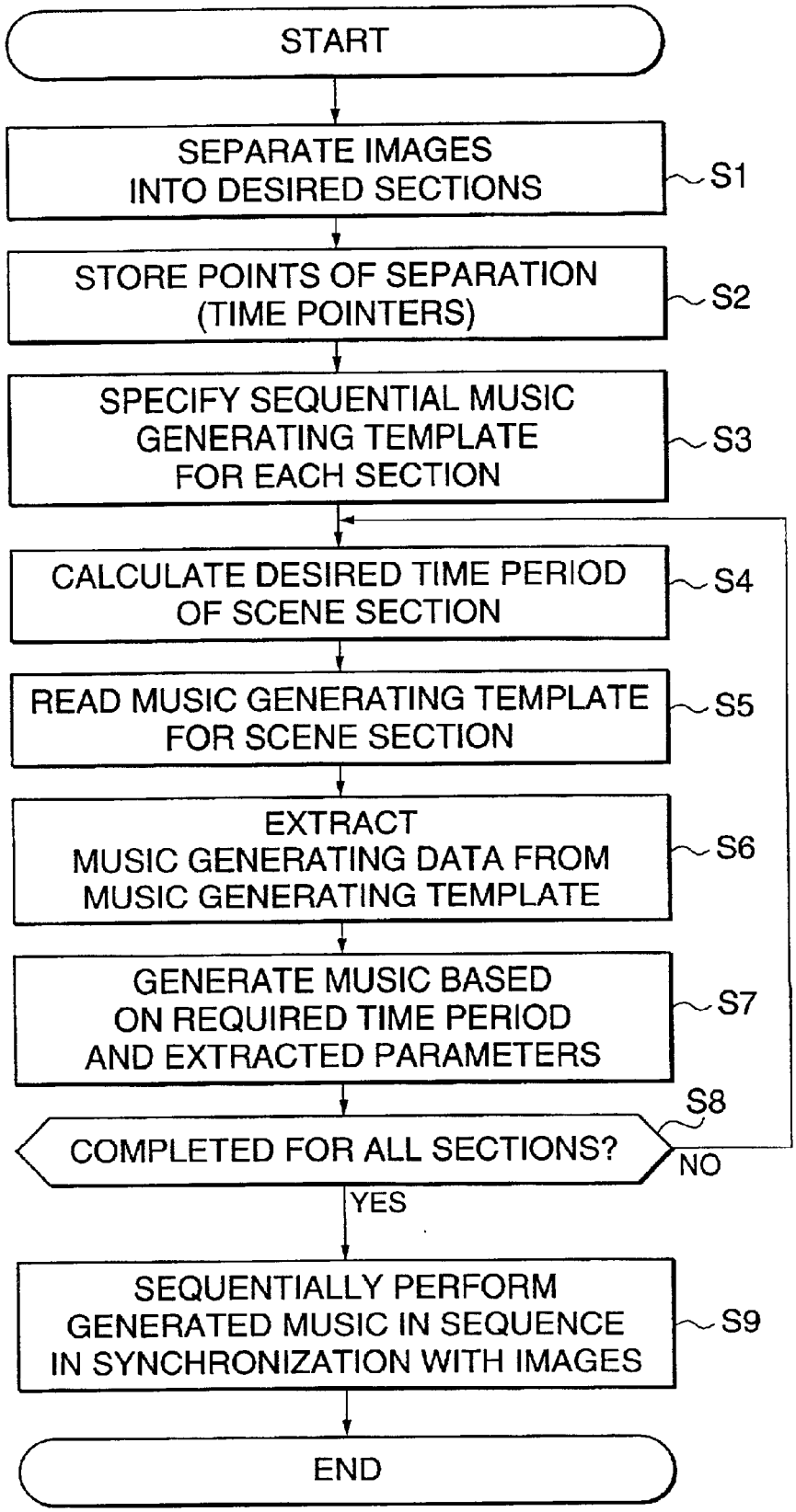
FIG. 3 is a flowchart showing processing for generating music that matches the length of images and for playing the generated music.

FIG. 3 is a flowchart showing processing for generating music that matches the length of images and for playing the generated music, which is executed by the automatic music composing apparatus according to the present embodiment.

First, a sequence of image information that is stored in the hard disk is read and expanded onto a predetermined area of the RAM 7. The images of the image information are then separated into sections (grouped into groups) as desired by a user using time pointers (step S1). The method used for dividing the images may be one in which the user sets desired sections by manually issuing an instruction via the panel switch 2, or one in which the CPU 5 detects image portions without images or detects image interlude portions and automatically sets sections according to those portions. Alternatively, when the sequence of image information is a sequence of a plurality of image files, then switch portions between the image files may be set as section boundaries.

Next, the CPU 5 stores the time pointers delimiting the images in a predetermined area of the RAM 7 (step S2). The user then specifies a music generating template in accordance with the image contents of each section (step S3). Here, the user decides the music generating template to be specified based on the name or keyword (for example, "Race", "Cheerful", etc.) of the respective music generating templates.

Next, based on the time pointers stored in step S2, the CPU 5 calculates time periods required for the delimited sections, namely, the time period required for the music to be generated (step S4). For example, for Scene A in FIG. 2, the required time period of 1 minute 30 seconds obtained by subtracting the time at the time pointer P1 from the time at the time pointer P2 is calculated. Here, if the time pointers show the required time period (i.e., the relative time period), then it is not necessary to calculate the required time period. If the time pointers show the number of frames, the required time period is determined by multiplying the number of frames by a unit time per frame.

Thereafter, the CPU 5 reads the music generating template specified in step S3 from the ROM 6 (step S5).

Here, the manner in which the time pointers stored in the predetermined area of the RAM 7 in step S2 and the music generating templates read from the ROM 6 in step S5 are arranged and stored in a predetermined area of the RAM 7 is shown in FIG. 4.

Next, data of parameters contained in the music generating data, namely, the melody generating data and the accompaniment generating data is extracted from the music generating template read in step S5 (step S6). For example, in the template "Race" shown in FIG. 2, data indicating that "Syncopation" is "Present", "Number of Musical Notes" is "Many", "Pitch Dynamics" is "High", and "Style" is "March" is extracted.

Next, the CPU 5 generates music based on the required time period for the music to be generated that was calculated in step S4 and the data of parameters extracted in step S6 (step S7). The CPU 5 then determines whether or not this music generating process has been completed for all the sections delimited in step S1 (step S8).

If the result of the determination in step S8 is that music generating process has not been completed for all the sections, the routine returns to step S4. If, however, the music generating process has been completed for all the sections, the generated music is played in synchronization with the image reproduction for each scene (step S9) and the processing routine is then terminated. A single piece of music may also be generated for the entire sections without dividing the images into a plurality of sections or groups. It is also possible for a single piece of music to be generated for a section containing a plurality of scenes as image contents.

Figure 5A:
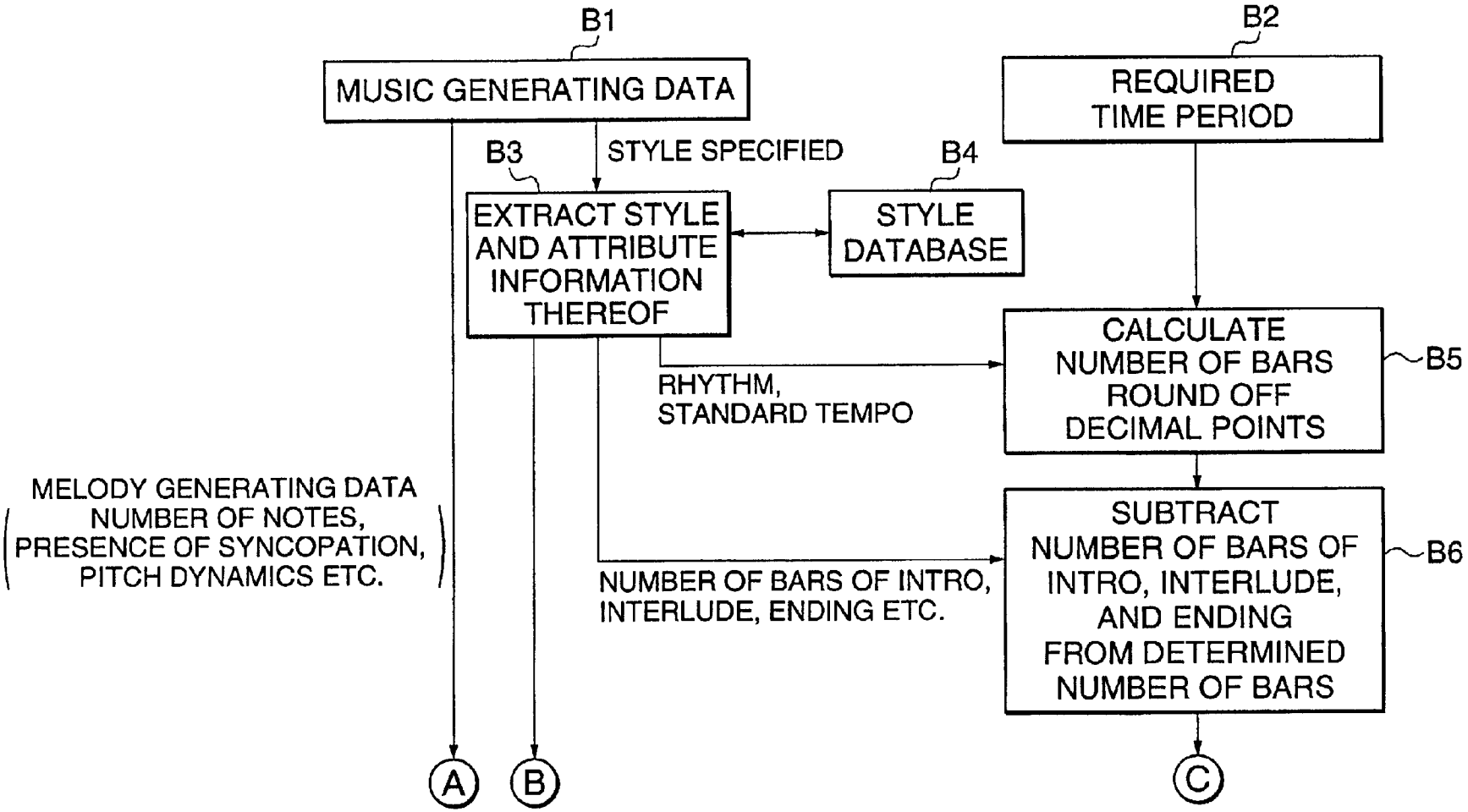
FIGS. 5A and 5B is a block diagram showing a routine of a music generating process in step S7 of FIG. 3.
Figure 5B:
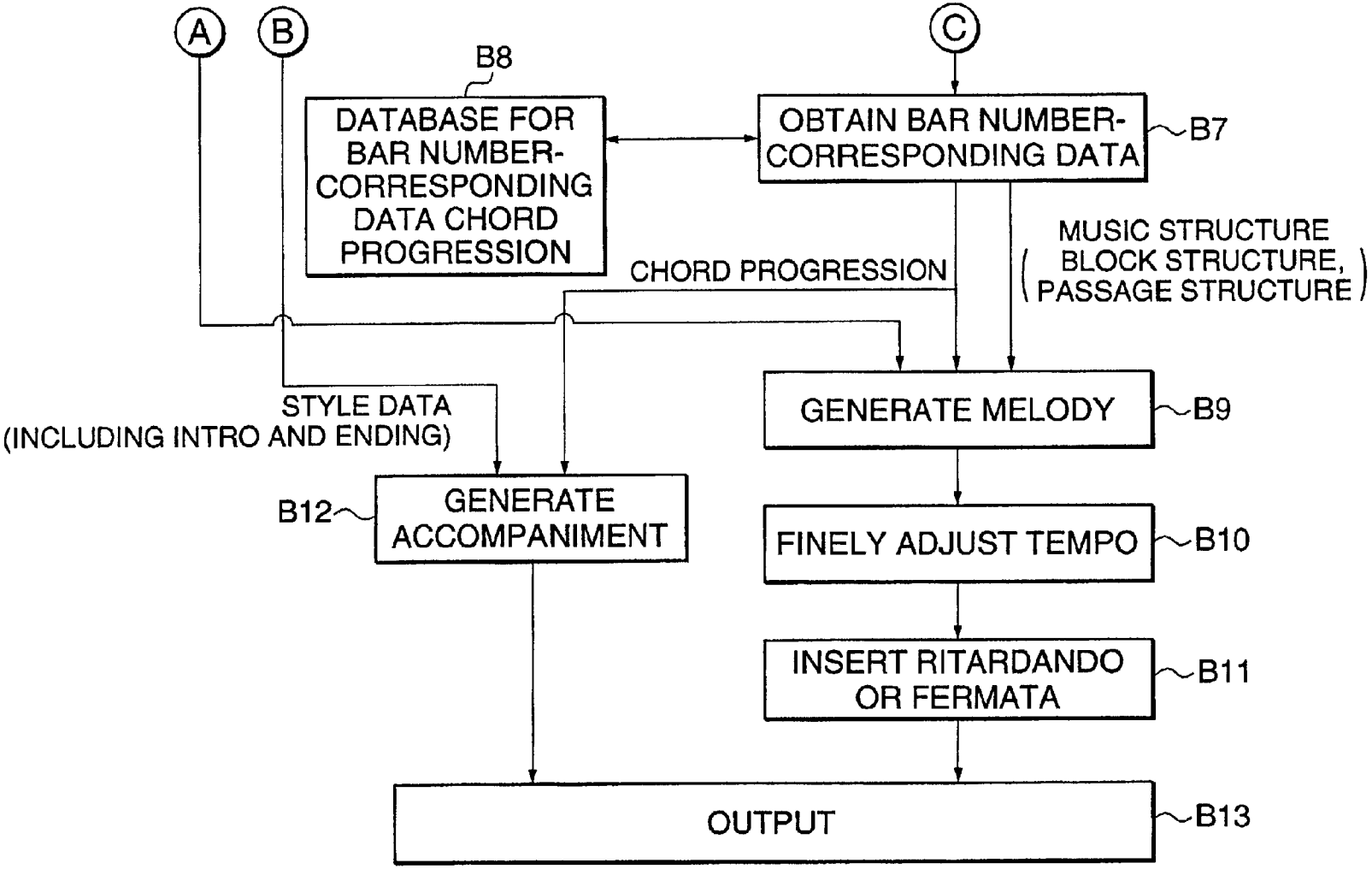

FIGS. 5A and 5B is a block diagram showing the routine of the music generating process in step S7 of FIG. 3, which is mainly executed by the CPU 5. In order to simplify the explanation, the procedure of the music generating process of FIGS. 5A and 5B is shown as a block diagram instead of as a flow chart. This shows processing by software that has been formed into blocks and not processing by hardware that has been formed into blocks.

The music generating data B1, required time period B2, style database B4, and bar number-corresponding data generating database B8 that are shown in FIGS. 5A and 5B all show data used in execution of the music generating process and do not show processing contents. The music generating data B1 is the data of the parameters extracted in step S6 of FIG. 3. The required time period B2 is the time period calculated in step S4 in FIG. 3. The style database B4 is stored, for example, in the ROM 6 and contains style data comprised of various types of accompaniment pattern data such as that for rock music, for pop music, or for jazz music. The style database B4 also contains attribute data comprised of time or meter, standard tempo, number of intro/interlude/ending bars, and an allowable amount of adjustment of the standard tempo for the above style data. The bar number-corresponding data generating database B8 is stored, for example, in the ROM 6 and contains data that depends on the music length such as block structures and passage structures chord progression and data relating to musical character or atmosphere. These data are stored as bar number-corresponding data generating templates.

First, a style is specified for the music to be generated based on data of the parameter "Style" contained in the music generating data B1. Based on the specified style for the music to be generated, style data and attribute data comprised of time, standard tempo, number of intro/interlude/ending bars, and the like for the above style data is extracted from the style database B4 (block b3).

Based on the time and standard tempo of the style data extracted in block B3, the number of bars needed for the required time period B2 is calculated using Formula (1) (block B5):

$$\text{Necessary number of bars} = \text{required time period B2}/[(60/\text{standard tempo}) \times \text{time}] \quad (1)$$

(wherein decimal points in Formula (1) are rounded off).

For example, when the time of the style data is four-four time, the standard tempo of the style data is 100, and the required time period B2 is 50 seconds, the necessary bar number is 50/[(60/100)×4]=20.8. By rounding this off, a value of 21 bars is obtained.

Next, the number of bars of the melody to be generated is calculated by subtracting the number of intro/interlude/ending bars extracted in block B3 from the necessary number of bars calculated in block B5(block B6). For example, when the required number of bars calculated in block B5 is 21 bars, the intro and ending are both 2 bars each, and there is no interlude, then 17 bars (=21−4) is the number of bars for the melody to be generated.

Subsequently, bar number-corresponding data that corresponds to the number of bars of the melody to be generated that was calculated in block B6 is acquired by referring to bar number-corresponding data generating templates stored in the bar number-corresponding data generating database B8 (block B7). Here, the bar number-corresponding data is comprised of a block structure, a passage structure, and chord progression. For example, when a bar number-corresponding data generating template stored in the bar number-corresponding data generating database B8 has a 4 bar unit (4, 8, 12, 16, 20 bars . . . ) block structure, passage structure, and chord progression, and the number of bars of the melody to be generated is 17, then 20 bars, which is the closest number of bars to 17 and greater than 17, is selected, 3 bars are then deleted, and data for a block structure, passage structure, and chord progression for 17 bars, namely, bar number-corresponding data is acquired.

Thereafter, melody data is generated based on the bar number-corresponding data acquired in block B7 and melody generating data (e.g., number of notes, presence/absence of syncopation, and pitch dynamics) contained in the music generating database B1 (block B9).

Next, fine adjustment is performed on the tempo of the melody data generated in block B9 (block B10). This fine adjustment of the tempo is performed in order to compensate a time error between the number of bars calculated in block B5 and the required time period B2, which is generated because the number of bars calculated in block B5 was rounded off.

Subsequently, a determination is made as to whether or not a melody generated based upon the melody data is musically unnatural as a result of the fine adjustment of the tempo in block B10. If the generated melody is musically unnatural, the processing to finely adjust the tempo in block B10 is canceled and the melody length is adjusted by inserting a ritardando (the tempo is gradually slowed) or fermata (notes and/or rests are unduly extended) (block B11). If, however, the melody generated in block B9 is musically natural, the processing to adjust the melody length in block B11 is canceled. Whether or not the generated melody is musically unnatural is determined, on the basis of data determining the allowable adjustment amount of the standard tempo contained in the style attribute data, according to whether or not the allowable adjustment amount of the standard tempo contained in the style attribute data has been exceeded. If the finely adjusted tempo exceeds the allowable adjustment amount of the standard tempo, the melody is determined to be musically unnatural.

An accompaniment is generated in parallel with the processing of blocks B9 to B11 based on style data (including the intro and ending) extracted in block B3 and the data of the chord progression acquired in block B7 (block B12).

Lastly, music is generated by combining the melody whose tempo was adjusted in block B11 (if the melody was musically unnatural) or block B10 (if the melody was musically natural) with the accompaniment generated in block B12. The generated music is then output and stored in the hard disk of the HDD 11 in correspondence with the respective scenes of the images (block 13). The music generating process is then terminated.

Figure 6:
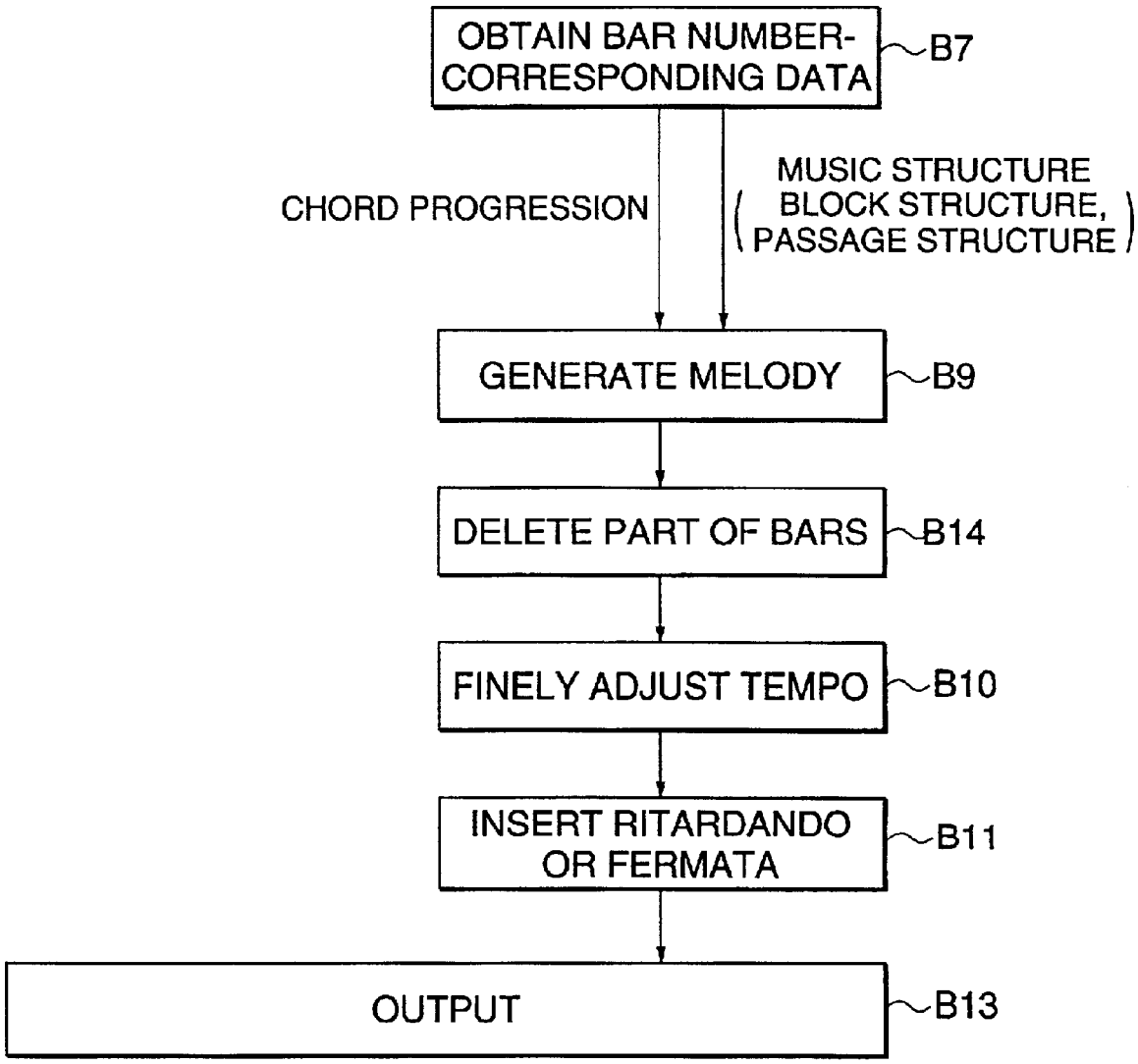
FIG. 6 is a block diagram showing a partially altered portion of the routine of the music generating process of FIGS. 5A and 5B.

In the above described music generating process, by deleting excess bar number-corresponding data in the bar number-corresponding data acquisition block B7, bar number-corresponding data that corresponds to the number of bars of the melody to be generated is acquired, and thereafter the melody is generated (block B9). However, as shown in FIG. 6, the process may be modified such that in block B7 only data corresponding to a number of bars that is greater than the number of bars of the melody to be generated is acquired, to generate a melody based on the acquired data (block B9), and to provide a block B14 that deletes excess melody bars so as to match the number of bars of the melody to be generated. When excess melody bars are deleted, it is preferable that they are deleted from the start of the music. If they are deleted from the end of the music, there is a fear that the sense of beginning and ending of the melody will disappear and the melody will sound unnatural. At this time, it is preferable that the positions of the boundaries between the passages of the melody, i.e. the points of delimiting the passages are not altered. For example, in the case of a melody consisting of 5 passages (4 bars 4 bars/4 bars/4 bars/4 bars=20 bars), each passage consisting of 4 bars, if 3 bars are deleted from the start of the melody, then the first passage is given a 1 bar structure with the remaining passages staying as they are (namely, 1 bar/4 bars/4 bars/4 bars/4 bars=17 bars). By employing this method, when passages are the same or similar, then this sameness or similarity can be maintained from at least the second passage onwards.

In the above described block B3, first, a style is specified for the music to be generated based on the music generating data B1 and then the time and standard tempo are set. However, depending on the images, there may be a case where a user wishes to set the time and standard tempo prior to the music style, in such a case, the time and standard tempo of the music may be first set, and after that a music style that corresponds to these may be selected, followed by style data and attribute data corresponding to the selected style being extracted.

In the above described block B6, the number of bars of the intro/interlude/ending that was used was extracted from attribute data, however, it is not necessary to use this number and a number specified by a user may also be used.

In the above described block B7 or block B14, in order to fit the number of bars of the melody to be generated, namely, in order to fit the required time period of the images, excess bar number-corresponding data or excess melody was deleted. However, this delete processing may be omitted, and when the music is played in synchronization with the images, the music may be played with a portion thereof omitted.

In the above described block B11, when the generated melody is musically unnatural, the fine adjustment of the tempo of block B11 is canceled and the melody length is adjusted. However, the melody length may be adjusted after performing the fine adjustment of the tempo of block B10.

An accompaniment is generated in the above described block B12, and the accompaniment and the melody are combined together in block B13. However, when accompaniment generating data is not contained in the style data, an accompaniment is not generated. Therefore, the accompaniment generation processing of block B12 and the accompaniment and melody combining processing of block B13 are not performed.

When the required time period B2 is long and there is no bar number-corresponding data generating template having a corresponding length, a number-corresponding data generating template having a smaller number of bars may be repeatedly applied, with an interlude having a predetermined number of bars inserted as required.

In the above described music generating process, bar number-corresponding data is acquired based on a bar number-corresponding data generating template, a melody is generated, and fine adjustment is performed on the tempo of the generated melody, namely, the standard tempo. However, when acquiring bar number-corresponding data based on a bar number-corresponding data generating template, a correction factor for the standard tempo applied when a bar number-corresponding data generating template is selected may be calculated, and the calculated correction factor for the standard tempo and the title of the bar number-corresponding data generating template may be displayed on the display device 9, so as to allow a user to select the bar number-corresponding data generating template that the user wishes to use.

For example, "1.21 Sorrowful Ballad", "0.96 Nostalgic Ballad" and the like are displayed on the display device 9 and the user is encouraged to select one of them. Here, the "1.21" of the "1.21 Ballad" displayed on the display device 9 is the correction factor for the standard tempo, while "Sorrowful Ballad" is the title of a bar number-corresponding data generating template. This display may consist of only the title of the bar number-corresponding data generating template and the correction factor for the standard tempo may not be displayed.

Alternatively, candidate correction factors for the standard tempo to be displayed on the display device 9 may be determined in advance, and only candidates that are within a predetermined correction factor range (for example, within a correction factor of 20% of the standard tempo) may be displayed on the display device 9, so that the user then selects from these candidates.

It is also possible to display on the display device 9 only a template having the lowest correction factor for the standard tempo from among bar number-corresponding data generating templates of a predetermined title in a particular category, and have the user select the displayed template. For example, if there are bar number-corresponding data generating templates having the title "Sorrowful ballad" in the category "Ballads", and if the bar number-corresponding data generating template for 4 bars has a correction factor for the standard tempo of 1.08, while the bar number-corresponding data generating template for 8 bars has a correction factor for the standard tempo of 1.12, then the template having the lowest correction factor (i.e., the closest to 1) for the standard tempo, namely, the template having the title "1.08 Sorrowful ballad" may be displayed on the display device 9 to be selected by the user.

It is also possible to display on the display device 9 only a template having the lowest correction factor for the standard tempo from among bar number-corresponding data generating templates of all titles in a particular category, and have the user select the displayed template. For example, if there are bar number-corresponding data generating templates having respective titles "Sorrowful ballad" and "Nostalgic Ballad" in the category "Ballads", and if the correction factor for the standard tempo of the bar number-corresponding data generating template for "Sorrowful Ballad" is 1.08, while the correction factor for the standard tempo of the bar number-corresponding data generating template for "Nostalgic Ballad" is 1.12, then the template having the lowest correction factor (i.e., the closest to 1) for the standard tempo, namely, the template having the title "1.08 Sorrowful ballad" is displayed on the display device 9 to be selected by the user.

Next, a method of acquiring bar number-corresponding data in block B7 in FIGS. 5A and 5B and a method of generating melody data in block B9 in FIGS. 5A and 5B will be described in detail.

Broadly speaking, there are four methods of acquiring bar number-corresponding data. Specifically, (1) a method in which bar number-corresponding data is acquired using templates prepared in 1 bar units, (2) a method in which bar number-corresponding data is acquired using calculations in 1 bar units, (3) a method in which bar number-corresponding data is first acquired using templates prepared in 4 bar units and then unnecessary bars are deleted, and (4) a method in which bar number-corresponding data is first acquired using calculations in 4 bar units and then unnecessary bars are deleted. Here, in the methods (3) and (4), bar number-corresponding data is first acquired in 4 bar units and then unnecessary bars are deleted. However, the method is not limited to 4 bars and the number of bars may be 2 or more. Note that, in the above description of block B7 of FIG. 3, an example is used of bar number-corresponding data being acquired using the method (3).

(1) Method in which Bar Number-Corresponding Data is Acquired Using Templates Prepared in 1 Bar Units A template for the necessary number of bars is selected from among 1 bar unit bar number-corresponding data generating templates stored in the bar number-corresponding data generating database B8.

According to this method, desired bar number-corresponding data can be generated using only 1 bar unit bar number-corresponding data generating templates, and melody data can be generated based directly on the generated bar number-corresponding data.

(2) Method in which Bar Number-Corresponding Data is Acquired Using Calculations in 1 Bar Units To acquire bar number-corresponding data by this method, 5 processes are required. Specifically, these are (i) block generation, (ii) setting number of passages within a block, (iii) setting a passage structure, (iv) setting number of bars of each passage, and (v) executing generation of chord progression.

Broadly speaking, there are two methods of executing these 5 processes. One method is comprised of firstdetermining number of blocks, number of passages within a block, and passage structure by random calculations (i.e., the processes (i) to (iii)), then allocating bars at random to the determined passages so that the total number of bars is equal to the desired number (i.e., process (iv)). The cadence of each passage or of each juncture between passages is then determined and diatonic chords or the like are given at random to portions other than the cadence-set end portions (i.e., process (v)). Thus, desired bar number-corresponding data is acquired.

The second method is comprised of first determining the number of blocks as a function of the number of bars (i.e. process (i)). An example of this function is expressed by Formula (2) given below:

Number of blocks (positive number)

$$=\text{rounded off}\,[f\,(\text{number of bars})]=\text{rounded off}\,[0.5\times[2/3+(1/3)\times(\text{number of bars})]] \quad (2)$$

According to this function, bars 1 to 4 are set as a first block, while passages 5 to 10 are set as a second block. It is to be noted that this function is not limited to Formula (2) given above.

Next, the number of passages within each block is set as a function of an optional number of bars such as the above Formula (2) (i.e., process (ii)). The passage structure and number of bars of each passage are determined by random calculations (i.e., processes (iii) and (iv)). The cadence of each passage or of each juncture between passages is then determined and diatonic chords or the like are given at random to portions other than the cadence-set end portions (i.e., process (v)). Thus, desired bar number-corresponding data is acquired.

In the above methods, bar number-corresponding data is acquired using calculations only. However, bar number-corresponding data may be acquired using a combination of calculation and tables.

3) Method in which Bar Number-Corresponding Data is First Acquired Using Templates Prepared in 4 Bar Units and then Unnecessary Bars are Deleted Desired bar number-corresponding data is acquired by selecting a template for a number of bars that is equal to the required number of bars or a number of bars that is slightly more than the required number of bars from 4 bar unit bar number-corresponding data generating templates that are stored in the bar number-corresponding data generating database B8, and then deleting unnecessary bars. When selecting bar number-corresponding data generating templates, they are selected based on data relating to musical character or atmosphere contained in the bar number-corresponding data generating templates.

According to this method, the number of bar number-corresponding data generating templates can be less than in the above method (1). However, processing is necessary to delete unnecessary bars after the bar number-corresponding data generating templates have been selected.

In the processing to delete unnecessary bars, it is preferable that the deletion should be made from the leading end of the bar number-corresponding data. If the deletion is made from the trailing end of the bar number-corresponding data, there is no sense of ending in the generated melody and there is a fear that the melody will sound unnatural. In this case as well, as is the same with the deletion of bars of the melody, it is preferable that the positions of the boundaries the passages of the bar number-corresponding data should not be altered. For example, if 3 bars are deleted from the start of bar number-corresponding data consisting of 5 passages, each passage consisting of 4 bars (4 bars/4 bars/4 bars/4 bars/4 bars=20 bars), then the first passage is given a 1 bar structure with the remaining passages staying as they are (namely, 1 bars/4 bars/4 bars/4 bars/4 bars=17 bars). By employing this method, when passages are the same or similar, then this sameness or similarity can be maintained from at least the second passage onwards.

According to this method, the time period taken to generate bar number-corresponding data that corresponds to the number of bars needed for melody generation may be shortened compared with method (1) above.

(4) Method in which Bar Number-Corresponding Data is First Acquired Using Calculations in 4 Bar Units and then Unnecessary Bars are Deleted In this method, bar number-corresponding data is acquired using calculations in combination with reference to tables shown in FIGS. 7 and 8, which will be described below. These tables are stored in the bar number-corresponding data generating database B8.

For example, when the required number of bars is 17, if these 17 bars are formed into passages consisting of 4 bar units, then this gives 4 passages and 1 bar. Accordingly, after bar number-corresponding data has been used to generate 5 passages, 3 bars are deleted. Next, the block structure and passage structure of these 5 passages are determined. FIG. 7 is a view of a table showing block structures (vertical axis) that can be used for selection of a block structure by the CPU 5 for a particular number of bars (horizontal axis).

In this table, there are 5 types of block structure that can be obtained when there are 5 passages. Namely, (i) when AB (or BA) is 2+3, namely, when block A is formed by 2 passages and block B is formed by 3 passages (or when block B is formed by 2 passages and block A is formed by 3 passages), (ii) when AB (or BA) is 3+2, (iii) when ABA (or BAB) is 1+2+2, (iv) when ABA (or BAB) is 2+1+2, and (v) when ABA (or BAB) is 2+2+1. In the table, symbols are allotted to the blocks according to the style of music, for example, block A is provided with a normal accompaniment while block B is provided with a flamboyant accompaniment, so that if block B is positioned first, music starting with a bridge can be generated.

Next, one block structure is selected from the five block structures. For example, if a selection is made based on the condition "fewest repetitions", then (i) AB (or BA) is 2+3 or (ii) AB (or BA) is 3+2 is selected. Thereafter, one of these two block structures is then selected at random, for example, (i) AB (or BA) is 2+3 is selected. Next, by referring to a table in FIG. 8, passage structures are determined, respectively, for block A and block B of the selected block structures. FIG. 8 is a view of a table showing passage structures (vertical axis) that can be used for selection of a passage structure by the CPU 5 for a particular number of passages (horizontal axis). In FIG. 8, if a particular passage is represented by a symbol "a", a passage having a different structure from this passage (namely, is neither the same as or similar to) is represented by a symbol "b" or "c". A passage having the same structure as this passage is represented by a symbol "a", while a passage having a similar structure to this passage is represented by a symbol "a'".

Here, since a passage structure when AB (or BA) is 2+3 is determined, first, a passage structure having two passages is determined. In the table in FIG. 8, there are 3 types of passage structure having two passages, "aa", "aa'", and "ab". Out of these, for example, if a selection is made based on the condition "fewest repetitions", then the passage structure "ab" is determined. In the same way, if a passage structure having three passages is being determined, then a passage structure "abc" is determined. Here, if the determination is made such that passage symbols are not duplicated between different blocks, the passage structure finally determined is "abcde".

The chord progression is generated based on the block structure and passage structure determined in the above described manner after the cadence at the last two bars of a passage and/or, simultaneously, the cadence heading from the end of a passage towards the start of the next passage have been decided.

In the described above manner, three excess bars are deleted from the acquired bar number-corresponding data (i.e., data of the block structure, passage structure and chord progression), so that the desired bar number-corresponding data is obtained.

In the above described method, the block structure and passage structure were determined using separate tables. However, a single table having both sets of data may be used to determine the block structure and the passage structure at the same time by referring to the table.

Next, as to the method of generating melody data, broadly speaking, there are two melody data generation methods. Specifically, these are a method in which a melody is generated for each bar so as to generate a melody having a desired number of bars, and a method in which a melody is generated for each unit of 4 bars so as to generate a melody having a desired number of bars.

Regardless of the method that is used, a melody is generated based on the bar number-corresponding data acquired in block B7 and the melody generating data contained in the music generating data B1.

However, when a melody is generated in units of 4 bars or like units, a melody is generated in a number of bars of fixed length, the processing is simplified compared with the case where a melody is generated for each single bar. For example, when a score is displayed on the display device 9, usually a score of 4 bars is displayed on one screen of the display device 9. The display processing for this is simpler than when the score is displayed for each single bar. Moreover, when similar types of melody are generated repeatedly due to the passages being the same or similar, the passages can be copied in fixed bar lengths thereby also simplifying the processing.

As has been described above, according to the present embodiment, bar number-corresponding data, which corresponds to the number of bars needed to generate a melody, is acquired, a melody is generated based on this bar number-corresponding data and data for generating a melody, fine adjustment is performed on the tempo of the melody such that the melody length of the generated melody matches the required time period of the images, and the melody length is adjusted by inserting ritardando or fermata. As a result, music with a high degree of completion that matches the length of images is generated. In addition, in the automatic music composing apparatus according to the present embodiment, a musical composition is automatically created using templates and calculations. As a result, unlike a conventional apparatus in which fragments of music data are simply joined together, an almost unlimited number of musical pieces having a high degree of completion can be generated. Furthermore, in the automatic musical composition creating apparatus according to the present embodiment, music reflecting styles such as marches, waltzes, or ballads is generated so as to match image scenes, music having a high degree of completion that is appropriate for the contents of images can be generated.

Furthermore, data corresponding to a number of bars that is greater than the number of bars of a melody to be generated, a melody is generated based on this data and data for generating a melody, and excess melody bars are deleted so as to match the number of bars of the melody to be generated. Therefore, music having a high degree of completion that matches the length of the images can be generated.

It is also possible to insert fadeout/fadein control commands in the music data, or to store these control commands under separate management from the music data, or to insert volume change data in the music data such that the music fades out and/or fades in at joints between scenes.

It goes without saying that the above described embodiment, modifications or variations may be realized even in the form of a program as software to thereby accomplish the object of the present invention.

Further, it also goes without saying that the object of the present invention may be accomplished by supplying a system or an apparatus with a storage medium in which is stored software program code realizing the functions of the above described embodiment, modifications or variations, and causing a computer (CPU or MPU) of the system or apparatus to read out and execute the program code stored in the storage medium.

In this case, the program code itself read out from the storage medium achieves the novel functions of the above embodiment, modifications or variations, and the storage medium storing the program constitutes the present invention.

The storage medium for supplying the program code to the system or apparatus may be in the form of a floppy disk, a hard disk, an optical memory disk, an magneto-optical disk, a CD-ROM, a CD-R (CD-Recordable), DVD-ROM, a semiconductor memory, a magnetic tape, a nonvolatile memory card, or a ROM, for example. Further, the program code may be supplied from a server computer via a MIDI apparatus or a communication network.

Further, needless to say, not only the functions of the above embodiment, modifications or variations can be realized by carrying out the program code read out by the computer but also an OS (operating system) or the like operating on the computer can carry out part or whole of actual processing in response to instructions of the program code, thereby making it possible to implement the functions of the above embodiment, modifications or variations.

Furthermore, it goes without saying that after the program code read out from the storage medium has been written in a memory incorporated in a function extension board inserted in the computer or in a function extension unit connected to the computer, a CPU or the like arranged in the function extension board or the function extension unit may carry out part or whole of actual processing in response to the instructions of the code of the next program, thereby making it possible to achieve the functions of the above embodiment, modifications or variations.

As was described above, the automatic music composing apparatus according to the above described embodiment is realized using a general purpose personal computer (PC) having a standard hardware structure. However, the present invention is not limited to this and the same effects may be obtained using a mobile PC that is not provided with either the FDD 10 or the CD-ROM 12. Moreover, it is not required that a general purpose PC be used and a dedicated apparatus may be employed instead.

What is claimed is:

1. An automatic music composing apparatus that automatically creates musical compositions to be reproduced as a background for images, comprising:

a bar number calculating device that calculates a number of bars of a musical composition that corresponds to a time period required by each of sections of images;

a bar number-corresponding data acquiring device that acquires bar number-corresponding data necessary to generate a melody of the musical composition and corresponding to a number of bars obtained by subtracting a number of bars of at least one of intro bar, interlude, bar, and ending from the calculated number of bars;

an accompaniment generating device that generates an accompaniment of the musical composition including at least one of intro, interlude, and ending;

a melody generating device that generates the melody of the musical composition based on the acquired bar number-corresponding data; and an output device that outputs the musical composition which is a combination of the generated melody and the generated accompaniment according to each of the sections of the images.

2. An automatic music composing apparatus according to claim 1, comprising a melody length adjusting device that adjusts a length of the melody such that the generated melody has a length matching a time period required by a corresponding one of the sections of the images, and wherein said output device outputs the musical composition having the length thereof adjusted, according to each of the sections of the images.

3. An automatic music composing apparatus according to claim 1, wherein said bar number-corresponding data acquiring device acquires the bar number-corresponding data in units of a predetermined number of bars, and wherein the apparatus comprises a deleting device that deletes a portion of the bar number-corresponding data such that the acquired bar number-corresponding data corresponds to a number of bars that is greater than and is closest to a number of bars required for generating the melody.

4. An automatic music composing apparatus that automatically creates musical compositions to be reproduced as a background for images, comprising:

a bar number calculating device that calculates a number of bars of a musical composition that corresponds to a time period required by each of sections of images;

a bar number-corresponding data acquiring device that acquires bar number-corresponding data necessary to generate a melody of the musical composition and corresponding to a number of bars obtained by subtracting a number of bars of at least one of intro bar, interlude bar, and ending from the calculated number of bars in units of a predetermined number of bars, said bar number-corresponding data acquiring device acquiring the bar number-corresponding data that corresponds to a number of bars that is greater than and is closest to a number of bars required for generating the melody;

an accompaniment generating device that generates an accompaniment of the musical composition including at least one of intro, interlude, and ending:

a melody generating device that generates the melody of the musical composition based on the acquired bar number-corresponding data;

a melody length adjusting device that adjusts a length of the melody such that the generated melody has a length matching a time period required by a corresponding one of the sections of the images; and an output device that outputs the musical composition which is a combination of the melody having the length thereof adjusted and the generated accompaniment according to each of the sections of the images.

5. An automatic music composing apparatus according to claim 4, wherein said melody length adjusting device comprises a bar number deleting device that deletes a portion of the number of bars of the melody generated by said melody generating device.

6. An automatic music composing apparatus according to claim 4, wherein said melody length adjusting device comprises a tempo adjusting device that adjusts a tempo of the melody generated by said melody generating device.

7. An automatic music composing apparatus according to claim 4, wherein said melody length adjusting device comprises an insertion device that inserts a ritardando or fermata in the melody generated by said melody generating device.

8. An automatic music composing apparatus according to claim 1, comprising a musical composition generation data acquiring device that acquires data for generating a musical composition appropriate to contents of images, the musical composition generation data including at least one data set each containing a plurality of types of musical composition generation parameters.

9. An automatic music composing apparatus according to claim 8, wherein said musical composition generation data acquiring device comprises a musical composition generation data storage device that stores a plurality of sections of musical composition generation data classified into predetermined categories, and wherein the at least one data set is read out from said musical composition generaton data storage device as a desired data set.

10. An automatic music composing apparatus according to claim 8, further comprising a section forming device that divides the images into a plurality of sections, and wherein said musical composition generation data acquiring device acquires the musical composition generation data for each of the sections of the images, said melody generating device generates the melody data for each of the sections of the images, and said output device outputs the musical composition data generated for each of the sections in correspondence with each of the sections of the images.

11. An automatic music composing apparatus that automatically creates musical compositions to be reproduced as a background for images, comprising:

a bar number calculating device that calculates a number of bars of a musical composition that corresponds to a time period required by images;

a bar number-corresponding data acquiring device that acquires bar number-corresponding data necessary to generate a melody of the musical composition and corresponding to a number of bars obtained by subtracting a number of bars of at least one of intro bar, interlude bar, and ending from the calculated number of bars;

an accompaniment generating device that generates an accompaniment of the musical composition including at least one of intro, interlude, and ending;

a melody generating device that generates the melody of the musical composition based on the acquired bar number-corresponding data; and an output device that outputs the musical composition which is a combination of the generated melody and the generated accompaniment together with the images.

12. An automatic music composing apparatus that automatically creates musical compositions to be reproduced as a background for images, comprising:

a bar number calculating device that calculates a number of bars of a musical composition that corresponds to a given required time period;

a bar number-corresponding data acquiring device that acquires bar number-corresponding data necessary to generate the musical composition and corresponding to the calculated number of bars in units of a predetermined number of bars, said bar number-corresponding data acquiring device acquiring the bar number-corresponding data that corresponds to a number of bars that is greater than and is closest to a number of bars required for generating the musical composition;

a bar number-corresponding data length adjusting device that adjusts a length of the acquired bar number-corresponding data by deleting part of bars of the acquired bar number-corresponding data from a leading end of the acquired bar number-corresponding data so that the bar number-corresponding data matches the calculated number of bars; and a musical composition generating device that generates the musical composition based on the bar number-corresponding data having a number of bars thereof adjusted.

13. An automatic music composing apparatus that automatically creates musical compositions to be reproduced as a background for images, comprising:

a bar number calculating device that calculates a number of bars of a musical composition that corresponds to a given required time period;

a bar number-corresponding data acquiring device that acquires bar number-corresponding data necessary to generate a melody of the musical composition and corresponding to a number of bars obtained by subtracting a number of bars of at least one of intro bar, interlude bar, and ending from the calculated number of bars in units of a predetermined number of bars, said bar number-corresponding data acquiring device acquiring the bar number-corresponding data that corresponds to a number of bars that is greater than and is closest to a number of bars required for generating the melody;

an accompaniment generating device that generates an accompaniment of the musical composition including at least one of intro, interlude, and ending;

a melody generating device that generates the melody of the musical composition based on the acquired bar number-corresponding data;

a melody length adjusting device that adjusts a length of the melody such that the generated melody has a length matching the required time period; and an output device that outputs the musical composition which is a combination of the melody having the length thereof adjusted and the generated accompaniment together with the images.

14. An automatic music composing apparatus according to claim 13, wherein said melody adjusting device comprises a bar number deleting device that deletes part of bars of the generated melody from a leading end of the generated melody.

15. An automatic music composing program that is executed by a computer, comprising:

a bar number calculating module for calculating a number of bars of a musical composition that corresponds to a time period required by each of sections of images;

a bar number-corresponding data acquiring module for acquiring bar number-corresponding data necessary to generate a melody of the musical composition and corresponding to a number of bars obtained by subtracting a number of bars of at least one of intro bar, interlude bar, and ending from the calculated number of bars;

an accompaniment generating module for generating an accompaniment of the musical composition including at least one of intro, interlude, and ending;

a melody generating module for generating the melody of the musical composition based on the acquired bar number-corresponding data; and an output module for outputting the generated musical composition which is a combination of the generated melody and the generated accompaniment according to each of the sections of the images.

16. An automatic music composing program that is executed by a computer, comprising:

a bar number calculating module for calculating a number of bars of a musical composition that corresponds to a time period required by each of sections of images;

a bar number-corresponding data acquiring module for acquiring bar number-corresponding data necessary to generate a melody of the musical composition and corresponding to a number of bars obtained by subtracting a number of bars of at least one of the intro bar, interlude bar, and ending from the calculated number of bars in units of a predetermined number of bars, said bar number-corresponding data acquiring module acquiring the bar number-corresponding data that corresponds to a number of bars that is greater than and is closest to a number of bars required for generating the melody;

an accompaniment generating module for generating and accompaniment of the musical composition including at least one of intro, interlude, and ending;

a melody generating module for generating the melody of the musical composition based on the acquired bar number-corresponding data;

a melody length adjusting module for adjusting a length of the melody such that the generated melody has a length matching a time period required by a corresponding one of the sections of the images; and an output module for outputting the musical composition which is a combination of the melody having the length thereof adjusted and the generated accompaniment according to each of the sections of the images.

17. An automatic music composing program according to claim 15, comprising a musical composition generation data acquiring module for acquiring data for generating a musical composition appropriate to contents of images, the musical composition generation data including at least one data set each containing a plurality of types of musical composition generation parameters.

18. An automatic music composing program that is executed by a computer, comprising:

a bar number calculating module for calculating a number of bars of a musical composition that corresponds to a time period required by images;

a bar number-corresponding data acquiring module for acquiring bar number-corresponding data necessary to generate a melody of the musical composition and corresponding to a number of bars obtained by subtracting a number of bars of at least one of intro bar, interlude bar, and ending from the calculated number of bars;

an accompaniment generating module for generating an accompaniment of the musical composition including at least one of intro, interlude, and ending;

a melody generating module for generating the melody of the musical composition based on the acquired bar number-corresponding data; and an output module for outputting the musical composition which is a combination of the generated melody and the generated accompaniment together with the images.

19. An automatic music composing program that is executed by a computer, comprising:

a bar number calculating module for calculating a number of bars of a musical composition that corresponds to a given required time period;

a bar number-corresponding data acquiring module for acquiring bar number-corresponding data necessary to generate the musical composition and corresponding to the calculated number of bars in units of a predetermined number of bars, said bar number-corresponding data acquiring module acquiring the bar number-corresponding data that corresponds to a number of bars that is greater than and is closest to a number of bars required for generating the musical composition;

a bar number-corresponding data length adjusting module for adjusting a length of the acquired bar number-corresponding data by deleting part of bars of the acquired bar number-corresponding data from a leading end of the acquired bar number-corresponding data so that the bar number-corresponding data matches the calculated number of bars; and a musical composition generating module for generating the musical composition based on the bar number-corresponding data having a number of bars thereof adjusted.

20. An automatic music composing program that is executed by a computer, comprising:

a bar number calculating module for calculating a number of bars of a musical composition that corresponds to a given required time period;

a bar number-corresponding data acquiring module for acquiring bar number-corresponding data necessary to generate a melody of the musical composition and corresponding to a number of bars obtained by subtracting a number of bars of at least one of intro bar, interlude bar, and ending from the calculated number of bars in units of a predetermined number of bars, said bar number-corresponding data acquiring module acquiring the bar number-corresponding data that corresponds to a number of bars that is greater than and is closest to a number of bars required for generating the melody;

an accompaniment generating module for generating an accompaniment of the musical composition including at least one of intro, interlude, and ending;

a melody generating module for generating the musical composition based on the acquired bar number-corresponding data;

a melody length adjusting module for adjusting a length of the melody such that the generated melody has a length matching the required time period ; and an output module for outputting the musical composition which is a combination of the melody having the length thereof adjusted and the generated accompaniment together with the images.

21. An automatic music composing apparatus according claim 1, wherein the bar number-corresponding data comprises a block structure, a passage structure, and chord progression.

* * * * *